US005464318A

United States Patent [19]

Eklund et al.

[11] Patent Number: 5,464,318

[45] Date of Patent: Nov. 7, 1995

[54] CONTROL SYSTEM FOR EXTRACTION AND INJECTION OF STEAM FROM AND INTO A TURBINE

[75] Inventors: Sivert Eklund, Finspång; Claes Jönsson, Norrköping; Lars-Göran Sjöberg, Finspång, all of Sweden

[73] Assignee: ABB Stal AB, Finspong, Sweden

[21] Appl. No.: 167,946

[22] PCT Filed: Jun. 9, 1992

[86] PCT No.: PCT/SE92/00389

§ 371 Date: Dec. 20, 1993

§ 102(e) Date: Dec. 20, 1993

[87] PCT Pub. No.: WO93/00501

PCT Pub. Date: Jan. 7, 1993

[30] Foreign Application Priority Data

Jun. 20, 1991 [SE] Sweden ..... 9101914

[51] Int. Cl.[6] ..... F01D 21/00

[52] U.S. Cl. ..... 415/28; 415/20; 60/662

[58] Field of Search ..... 415/13, 17, 20, 415/26, 27, 28; 60/662

[56] References Cited

U.S. PATENT DOCUMENTS

| | | | |
|---|---|---|---|
| 3,342,195 | 9/1967 | Wagner | 60/662 |
| 3,487,993 | 1/1970 | Rannenberg | 415/28 |
| 4,118,935 | 10/1978 | Andersson | 60/662 |
| 4,156,578 | 6/1979 | Agar et al. | 415/17 |
| 4,309,873 | 1/1982 | Koran et al. | 60/662 |
| 4,448,026 | 5/1984 | Binstock et al. | 60/662 |
| 5,242,263 | 9/1993 | Mondoloni | 415/28 |

FOREIGN PATENT DOCUMENTS

| | | | |
|---|---|---|---|
| 0226505 | 10/1986 | Japan | 415/17 |
| 0195403 | 8/1987 | Japan | 415/26 |
| 4259605 | 9/1992 | Japan | 415/20 |

OTHER PUBLICATIONS

Derwent's Abstract No. H79 E/26, SU 861 666.

*Primary Examiner*—Edward K. Look
*Assistant Examiner*—Mark Sgantzos
*Attorney, Agent, or Firm*—Pollock, Vande Sande & Priddy

[57] ABSTRACT

The present invention relates to a control system for controlling injection and extraction of steam in a steam turbine (1), the same valves (5,6) being used both for injection of steam to the turbine (1) and for extraction of steam from the turbine (1) . The valves (5, 6) commonly used for injection and extraction are controlled to be timely opened and closed in dependence on the pressure conditions at injection points (2,3) and extraction points (2,3), respectively, in the turbine and on the pressure (P3) prevailing in a process network connected to the valves (5, 6) such that injected or extracted steam is utilized in an optimal manner.

8 Claims, 1 Drawing Sheet

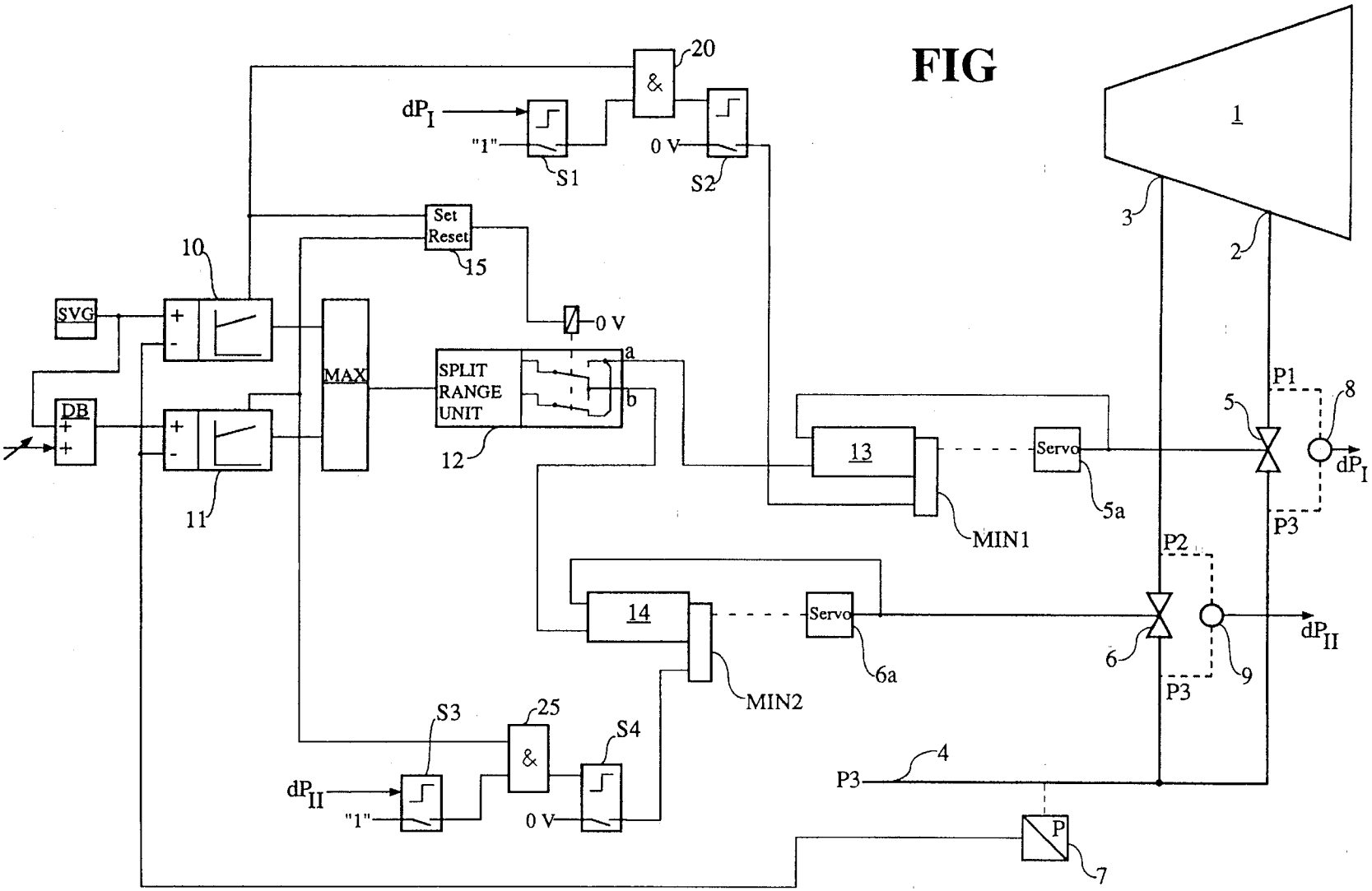
FIG

CONTROL SYSTEM FOR EXTRACTION AND INJECTION OF STEAM FROM AND INTO A TURBINE

TECHNICAL FIELD

The present invention relates to a control system for control of steam flows when injecting and extracting steam in connection with steam turbines, especially when using steam turbines in industrial processes where the steam consumption of the turbine varies.

BACKGROUND OF THE INVENTION

In certain applications industrial steam turbines are connected to a process network with greatly varying steam consumption. An optimal utilization of the turbine then receives that at certain times steam is to be injected into the turbine from the process network, whereas on other occasions steam is to be extracted from the turbine to the process network.

In order to inject and extract steam at an optimal location in the turbine, multi-point injection/multi-point extraction in accordance with known methods for injection/extraction of steam within the turbine technique are utilized. In the case of injection, the optimal point is as high up in the turbine as possible, that is, it takes place at a point in the turbine with high steam pressure. Optimal extraction is carried out in a corresponding manner as far down in the turbine as possible, that is, at a point with low pressure in the turbine.

According to the conventional technique for externally controlled extraction or injection, separate valves are currently used for controlling the steam flows for injecting steam into the turbine, that is, a number of valves equal to the number of injection points are controlled to open and close to control any steam flows to the different injection points. In a corresponding way, any steam flows from the turbine through extraction points in the turbine are controlled by means of separate valves in connection with extraction of steam from the turbine. The number of extraction valves is then equal to the number of steam extraction points from the turbine.

Consequently, with the current technique for controlling injection and extraction of steam into and from a steam turbine, it is necessary to provide a number of valves equal to the sum of the number of injection and extraction points in the turbine. This entails a large cost for the valves and an unnecessarily complicated valve control as well as, in certain cases, disadvantages from the performance point view of.

SUMMARY OF THE INVENTION

The present invention relates to a control system for control of injection and extraction of steam in a steam turbine in which, the same valves being used both for injection of steam into the turbine and extraction of steam from the turbine. The valves which are common for injection and extraction are controlled to be timely opened and closed in dependence on pressure conditions at injection points and extraction points, respectively, in the turbine and on the pressure prevailing in the process network connected to the valves such that injected or extracted steam is utilized in an optimal manner.

The conduits for extraction of steam are the same as the conduits for injection of steam.

In the following description, a valve is designated and considered a lower valve if it communicates with and controls the steam from and to an extraction/injection point, respectively, which is located at a connection point of the turbine at a lower pressure level in relation to the other extraction/injection points. Correspondingly, a valve is designated a higher valve if it communicates with and controls the steam flow from an extraction/injection point which is located at a connection point of the turbine at a higher pressure level in relation to the other extraction/injection points.

The present invention operates according to the principle that valves during, for example, extraction of steam are opened in,a certain sequence. Primarily, a lowest valve is opened which extracts steam from that of the two extraction conduits which is in communication with the extraction point with the lowest steam pressure in the turbine, referred to here as the lowest extraction point. If, at some time, the pressure at the lowest extraction point does not maintain a value which is necessary for the connected process network, which is sensed by a differential pressure gauge across the valve, this lowest valve is closed, whereas a higher valve which attends to the extraction of steam from a higher extraction point located at a point in the turbine with a prevailing higher steam pressure is opened and extracts steam to the process network. If the pressure level at lower extraction points should again rise, the lower valve is opened again, the higher valve thus being closed. This would produce the desired effect, that is, that steam with the lowest pressure would be extracted.

If extraction from more than two extraction points is controlled in a way according to the present invention, valves for extraction of steam are opened sequentially towards the extraction points with increasing steam pressure. However, a return to more optimal extraction is constantly made if the pressure at an extraction point with lower steam pressure again exhibits a value exceeding the pressure in the connected process conduit, whereby, sequentially, valves controlling the steam flow in extraction conduits are opened stepwise with increasingly lower pressure until the extraction conduit with the lowest steam pressure which exceeds the process pressure is open for extraction of steam from the turbine.

When injecting steam, the same valves as those mentioned above are controlled to be opened in a sequence which is opposite to the sequence during the extraction. This means that in case of two-point injection, steam from the process network, if the pressure of this steam is sufficient, is primarily injected via the opened highest valve to that of the two injection conduits which is connected to the higher pressurized part in the turbine, which is here referred to as the highest injection point. If the pressure of the steam from the process network at some time should be lower than the pressure at this highest injection point in the turbine, this highest valve is closed whereas the lower valve is opened to make possible injection of steam from the process network at a point in the turbine with lower pressure, which is done at a lower injection point in the turbine. If the pressure level of the steam in the process network should rise again, the injection at the higher pressure will change to the highest injection point in the turbine provided that the steam pressure in the process network is at least as great as the pressure at the highest injection point of the turbine.

If the injection of steam into more than two injection points is controlled in a way according to the invention, valves for injection of steam to the turbine are opened in sequence towards injection points with reduced steam pressure. However, a return to more optimal injection is constantly made if the pressure at an injection point with higher steam pressure again exhibits a value lower than the pressure in the connected process conduit, whereby, sequentially, valves controlling the steam flow in injection conduits are opened stepwise with increasingly higher pressure until the injection conduit with the highest steam pressure which is lower than the process pressure is open for injection of steam to the turbine.

Electronic control equipment attends to opening and closing of the servo valves for achieving injection or extraction of steam to the optimal injection or extraction points in the turbine in dependence on pressure conditions in a process network connected to the turbine and at injection and extraction points.

BRIEF DESCRIPTION OF THE DRAWING

The sole FIGURE illustrates a diagram of a control system for two-point extraction and injection of steam, respectively, in a steam turbine connected to a process network.

DESCRIPTION OF THE PREFERRED EMBODIMENTS

In the following, an embodiment of a control system according to the invention for extraction and injection of steam in a turbine will be described, in which extraction of steam from the turbine and injection of steam to the turbine, respectively, are carried out, by describing, in the example, the function of the control system for two-point extraction and injection.

The FIGURE illustrates a steam turbine 1, which symbolizes two or more turbine stages with a lowest tapping point 2 and a highest tapping point 3 for steam from and to the turbine 1, respectively. Consequently, the tapping points 2, 3 in the turbine 1 serve as both injection point and extraction point and will be referred to in the following according to their current function.

Extraction and injection of steam at the tapping point 2 are performed by a lowest servo valve 5 with an associated servo 5*a*. In a corresponding way, extraction and injection of steam at the tapping point 3 are performed by a highest servo valve 6 with an associated servo 6*a*. The tapping points 2, 3 of the turbine 1 for injection and extraction of steam are connected via the valves 5, 6 to a connecting conduit common to the two valves, so called process conduit 4, which in turn is connected to a process network. The process conduit 4 supplies steam to the process network during extraction or removes steam from the process network during injection. The steam pressure P3 in the process network is measured at the process conduit 4 by a pressure gauge 7.

The pressure difference between the steam pressure P3 in the process network and the pressure P1 at the lowest tapping point 2, that is, the pressure across the lowest valve 5, is measured by means of a differential pressure gauge 8, which supplies an output signal $dP_I$ which indicates if P3>P1. In a corresponding way, the pressure difference between the steam pressure P3 in the process network and the pressure at the highest tapping point 3, that is the pressure across the highest valve 6, is measured with a differential pressure gauge 9, which in turn supplies an output signal $dP_{II}$ which indicates if P2<P3.

The output signal from the pressure gauge 7 which measures the steam pressure in the process conduit 4 is supplied to a first control unit 10 and to a second control unit 11. The first control unit 10 is active during extraction of steam from the turbine 1, whereas the second control unit 11 is active during injection of steam to the turbine 1. The two control units 10, 11 have a common set value generator SVG, which sets a reference value pressure level for the control units 10, 11 through a dead-band unit DB. The dead-band unit DB provides a dead band in the control system, which dead band defines a certain small pressure interval within which activation of another control unit cannot take place to ensure for the control system a distinct switchover between the two control units 10, 11 in dependence on the pre-set reference value pressure and the current pressure P3 in the process network for activation of the correct control unit 10, 11 depending on whether extraction or injection of steam is called for. The two control units 10, 11 act on the valves 5, 6 through a maximum value selector MAX, which allows the greater of the two signals from the two control units 10, 11 to be passed on to a split-range device 12. The split-range device 12 operates according to the sequence a-b when the extraction unit 10 is activated, that is, extraction of steam from the turbine is to be carried out. This causes devices connected to the output a of the split-range device 12 to be controlled, in this case a servo position control unit 13 for the valve servo 5*a* for the lowest valve 5, before devices connected to the output b of the split-range device 12 receive control signals from the split-range device 12. The split-range device 12 operates in a corresponding way but in the sequence b-a when the injection control unit 11 is activated, which means that devices connected to the output b, in the present example a servo position control unit 14 for the valve servo 6*a* for the highest valve 6, are controlled before devices connected to the output a receive control signals from the split-range device. Switching between the two sequences of the split-range device 12 is carried out by a switching member 15, which senses which of the control units 10, 11, monitoring extraction and injection, respectively, is active. The switching member 15 has a Set-Reset function, which is controlled by an active control unit 10, 11.

In extraction mode the lowest valve 5 and the highest valve 6 operate sequentially controlled, the lowest valve 5 being opened first, provided that the pressure conditions are fulfilled, that is, that P3<P1. The highest valve 6 is opened only if the steam flow through the lowest valve 5 is insufficient to maintain the required process pressure P3. If the process pressure P3 is greater than P1, opening of the lowest valve 5 is prevented by a member for forced closing comprising the switches S1, S2 and the AND gate 20, which influence the valve servo 5*a* to close the lowest valve via a MIN-value selector MIN1. The entire extraction steam flow will then pass through the highest valve 6. The blocking or forced closing of the lowest valve 5 can only be activated when the control unit 10 for extraction is active. If the lowest valve is blocked and the pressure difference across the lowest valve should change, so that P3 again becomes smaller than P1, for example because of a change of the stated output or caused by a changed process steam consumption, that is, a change of P3, sequential control will be resumed automatically, which means that the lowest valve which is first in the sequence opened is again.

In injection mode the lowest valve 5 and the highest valve 6 operate sequentially controlled, the highest valve 6 being first opened and the lowest valve 5 being opened only if the steam flow through the highest valve 6 is insufficient to maintain the required process pressure, that is, if, for example, the highest valve is unable to swallow the required steam flow. If the pressure on the turbine side of the highest valve 6 should become too high to allow any injection at all, that is, if the pressure P2 becomes greater than P3, the highest valve 6 is blocked or forcibly closed via a blocking member comprising the switches S3, S4 as well as the AND gate 25, which influence the valve servo 6*a* to close the highest valve via a MIN-value selector MIN2, the entire steam flow thus being controlled to the turbine 1 via the valve 5 during injection. The forced closing of the highest valve 6 can only be activated when the control unit 11 for injection is active. If the highest valve 6 is blocked and the differential pressure across the highest valve should change, caused, for example, by a change of the output, normal sequential control is automatically resumed, the highest valve 6 which lies first in the control sequence during injection thus being opened again.

During extraction the first member for forced closing can block the lowest valve 5, if necessary. The member comprises a switch S1, which is controlled by the signal $dP_I$ from the differential pressure gauge 8. The control signal influences a contact in the switch S1, on the input of which there is permanently a logical one. When the signal $dP_I$ indicates that the pressure P3 is greater than P1, the contact in the switch S1 is closed, whereby a logical one is fed via the output of the switch to an AND gate 20. On the other input to the AND gate 20 there is a logical one if extraction is to be carried out. From this follows that the AND gate passes on a logical one via its output to a switch S2. The switch S2 receives this logical one from the AND gate 20 as a control signal, the contact in the switch S2 thus being closed, which means that an analog zero bias is passed on via the contact in the switch S2 to the MIN-value selector MIN1. Since the MIN-value selector MIN1 senses this zero bias as the lowest applied signal voltage, the valve servo 5*a* will close the lowest valve 5 for extraction. If the pressure P3 in the process network is smaller than the extraction pressure P2, the switch S1 is not closed, or if extraction is not to be carried out, such that a logical one is not fed from the control unit 10 to the AND gate 20, consequently in both cases no forced closing of the lowest valve 5 takes place, since zero bias is not present out from the switch S2. In these cases, the position of the lowest valve 5 is determined by the split-range device 12.

In the same way as for the lowest valve 5, during injection the highest valve 6 is controlled to forced closing if the injection pressure from the process network P3 is lower than the pressure P2 at the turbine side of the highest valve.

The control system according to the description may be extended to control extraction and injection of steam at three or more common tapping points in a turbine. In such an extended control system with, for example, three valves, there is instead used a split-range device with the sequence a-b-c during opening of the valves in connection with extraction and the sequence c-b-a in connection with injection. At the same time, an additional forced closing device for the third valve is introduced in accordance with the solution described above, where the differential pressure across the third valve via the third forced closing device determines whether this third valve has to be closed.

I claim:

1. A control system for controlling extraction and injection of steam in a steam turbine with at least two extraction/injection points, said steam turbine being connected to a process network, said control system comprising: at least two valves, each of said valves being associated with an extraction/injection point, and control equipment for controlling operation of said valves for extraction and injection of steam into said steam turbine, wherein the valves which are used for extraction of steam from the steam turbine to the process network are the same as the valves which are used for injection of steam from the process network to the turbine.

2. A control system according to claim 1, wherein the extraction of steam is effected by opening of a valve associated with an extraction point in the turbine with the lowest steam pressure, said lowest steam pressure exceeding a steam pressure of the process network; and wherein the injection of steam is effected by opening of a valve associated with an injection point in the turbine with the highest steam pressure, said highest steam pressure being lower than the steam pressure of the process network.

3. A control system according to claim 2, further comprising a pressure gauge, a set value generator, and a first and second control unit and wherein in dependence on a comparison of said steam pressure in the process network sensed by said steam pressure gauge and a pre-set reference value in said set value generator it is determined whether extraction or injection is to be carried out, whereby in case of extraction said first control unit is activated and in case of injection said second control unit is activated.

4. A control system according to claim 1, wherein said valves comprise at least a lower valve and a higher valve, said lower and higher valves being operated in a sequence during injection and extraction of steam and wherein during the extraction of steam said lower valve is opened first in the sequence and during the injection of steam said higher valve is opened first in the sequence.

5. A control system according to claim 4, further comprising an active control unit connected to and controlling a split-range device, which determines an injection sequence or an extraction sequence for opening of the valves.

6. A control system according to claim 5, further comprising a member including switches and an AND gate, which in case of simultaneous active extraction and a differential pressure signal $dP_I$, from an active lower valve for extraction, showing an extraction pressure which is lower than the pressure P3 in the process network, forcibly closes said lower valve, whereby the extraction switches over to the nearest higher valve.

7. A control system according to claim 5, further comprising a member including switches and an AND gate, which in case of simultaneous active injection and a differential pressure signal $dP_{II}$, from an active higher valve for injection, showing an injection pressure exceeding the pressure P3 in the process network forcibly closes said higher valve, whereby the injection switches over to the nearest lower valve.

8. A control system according to claim 6, further comprising another member including switches and an AND gate, which in case of simultaneous active injection and a differential pressure signal $dP_{II}$, from an active higher valve for injection, showing an injection pressure exceeding the pressure P3 in the process network forcibly closes said higher valve, whereby the injection switches over to the nearest lower valve.

* * * * *